United States Patent [19]

Dodge

[11] Patent Number: 4,735,004

[45] Date of Patent: Apr. 5, 1988

[54] SELF-CLOSING SKI BOOT

[75] Inventor: David J. Dodge, Shelburne, Vt.

[73] Assignee: Lange International S.A., Fribourg, Switzerland

[21] Appl. No.: 44,785

[22] Filed: Apr. 17, 1987

[51] Int. Cl.[4] ..... A43B 5/04; A43C 11/00

[52] U.S. Cl. ..... 36/117; 36/50; 36/12; 24/68 SK; 24/68 B

[58] Field of Search ..... 36/117–121, 36/50; 24/71.1, 71.2, 68 B, 68 SK, 69 WT, 70 CT, 71 CT

[56] References Cited

U.S. PATENT DOCUMENTS

| | | | |
|---|---|---|---|
| 4,571,855 | 2/1986 | Blanc | 36/120 X |
| 4,669,201 | 6/1987 | Pozzobon | 36/120 |
| 4,677,771 | 7/1987 | Arieh et al. | 36/120 |
| 4,680,878 | 7/1987 | Pozzobon et al. | 36/117 |

FOREIGN PATENT DOCUMENTS

| | | | |
|---|---|---|---|
| 0213613 | 3/1987 | European Pat. Off. | 36/117 |
| 2448872 | 9/1980 | France | 36/117 |

*Primary Examiner*—James Kee Chi

*Attorney, Agent, or Firm*—Kane, Dalsimer, Sullivan, Kurucz, Levy, Eisele and Richard

[57] ABSTRACT

This shell-type ski-boot comprising a lower portion molded integrally with the sole and an upper made of a front quarter and a rear quarter pivotally interconnected and fulcrumed on the lower portion, is proveded with a telescopic traction device adapted to close the upper tightly and automatically when the front quarter is bent forwards. The telescopic traction device comprises a male member and a female member the relative axial sliding movement of which causes the rear quarter of the upper to move toward the front quarter. For this purpose, a pair of cables anchored to the rear face of the rear quarter are guided around the boot sides and inside a pulley-block comprising two sets of pulleys, one set being fixed and the other movable for varying the cable length and therefore the degree of tightening of the boot on the skier's ankle.

6 Claims, 2 Drawing Sheets

Fig.3
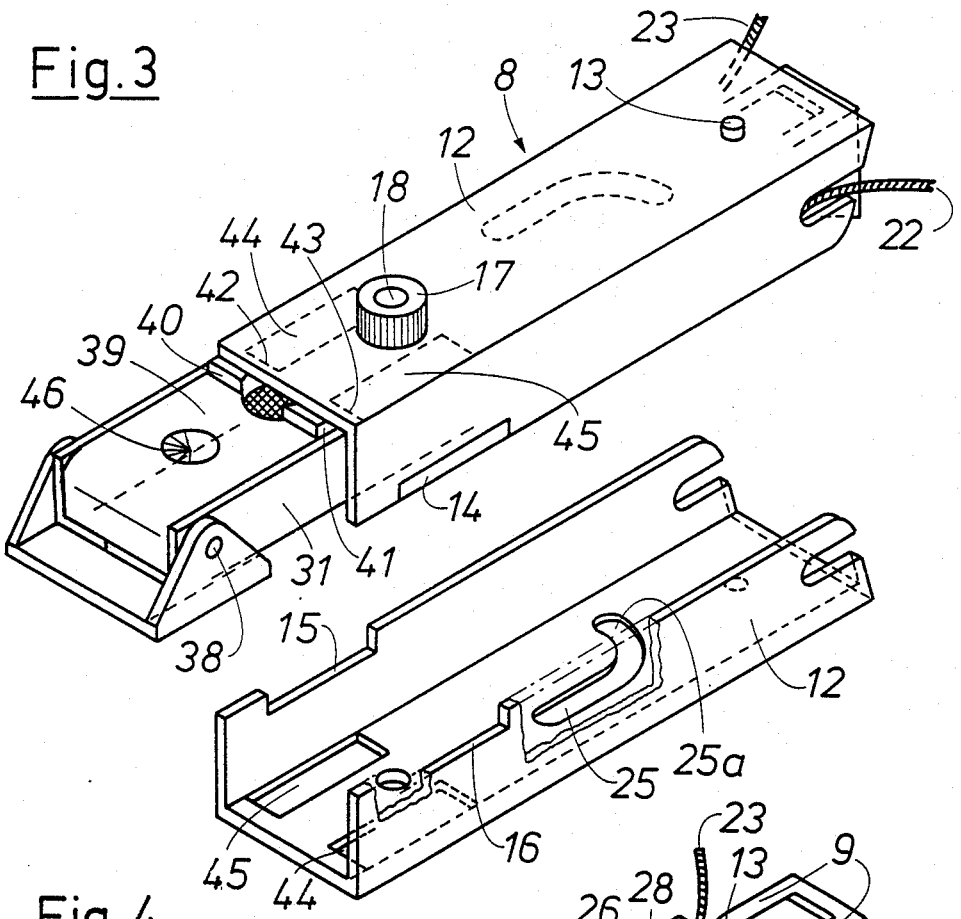
Fig.4
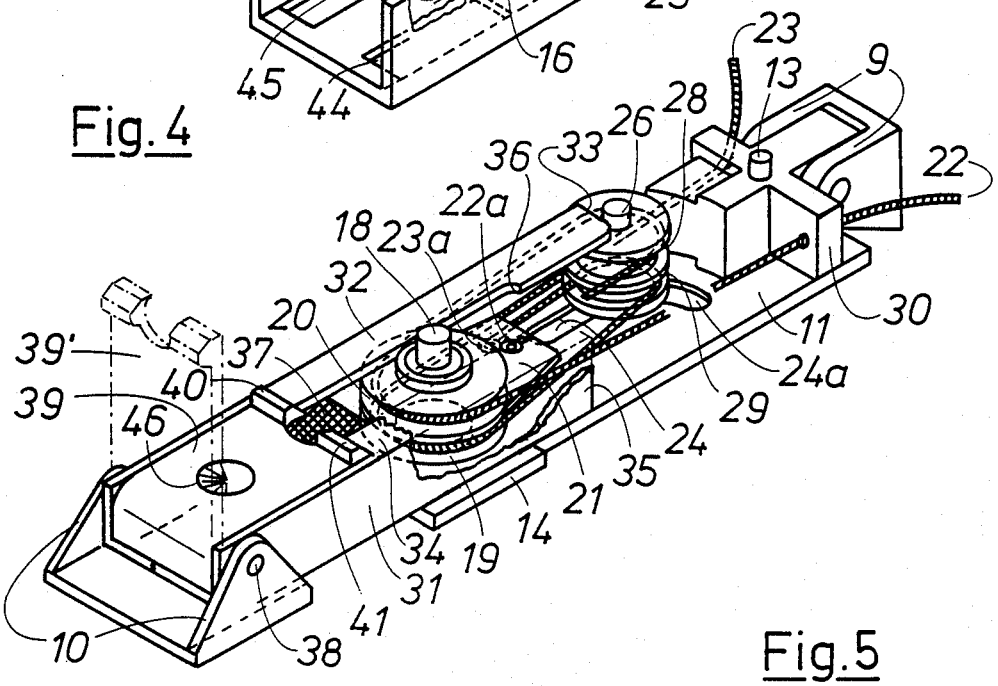
Fig.5

SELF-CLOSING SKI BOOT

FIELD OF THE INVENTION

The present invention relates to shell-type ski boots of the type opening at the heel end of the boot and comprising a rigid lower portion, an upper fulcrumed on this lower portion and consisting of a front quarter and a rear quarter pivotally interconnected, and means for closing the upper which are actuated automatically when the front quarter of the upper is bent forwards.

THE PRIOR ART

A ski boot of this type is disclosed in the U.S. Pat. No. 4,551,933. In this prior art structure the rear quarter of the pivoting upper or leg engages in its open or backward tilted position a notch formed in the lower portions of the shell, this pivoting movement causing a spring to be tightened. Bending the front quarter of the upper releases the rear quarter which is thus closed against the front quarter by the resilient force of the spring.

On the other hand, a self-closing ski boot is also known wherein a rear cover is closed automatically by a mechanism responsive to an inner sole when the user exerts a pressure on this inner sole (JP-A-57 86 301).

In these prior art structures the rear cover is tilted back abruptly on the ankle. Moreover, the self-closing system does not tighten the upper.

It is therefore the basic object of the present invention to provide a smoother self-closing arrangement capable of simultaneously gripping the upper around the user's leg.

SUMMARY OF THE INVENTION

The ski boot self-closing action is obtained according to the present invention by exerting a tractive effort on cables, without resorting to any return spring causing the abrupt closing of the rear quarter of the upper. This closing movement can take place very smoothly as desired by the user. Moreover, it is a simple matter to provide on the rear quarter of the boot means for adjusting the final tension of the cables when the traction device is in its locking postion.

By using a pulley-block it is possible to solve satisfactorily the problem arising heretofore from the substantial difference existing between the relatively reduced permissible angular movement of the front quarter of the upper and the desired relatively ample movement of the rear quarter of the upper. In fact, by using a pulley-block the movement of the front quarter of the upper can be multipled. On the other hand, the use of guide means, notably in the form of grooves having a curved section for the set of movable pulleys, provides an efficient solution of the problem arising from the upper flexion when skying. In fact, it is desirable that the tightening force does not increase during this flexion movement of the upper.

Moreover, in the present invention the problem consisting in incorporating automatic reciprocal locking means for controlling telescopic component elements is solved satisfactorily by using a pawl disposed at the toe end of the boot and therefore within easy reach of the skier. Furthermore, a quick-release action may be obtained by simply depressing the pawl with the tip of a ski pole.

By using two telescopic members, it is furthermore possible to fit a resilient abutment member inside the telescopic assembly, thus imparting simultaneously an elastic flexibility or resiliency to the upper. In a preferred form of embodiment, this resilient member acts at the same time as a resilient return means controlling an automatic locking pawl.

BRIEF DESCRIPTION OF THE DRAWINGS

FIG. 3 is a perspective view showing on a larger scale the traction device in the position preceding the locking position;

FIG. 4 is another perspective view from beneath showing the female tubular member of the traction device of FIG. 3, and FIG. 5 is a perspective view, with parts broken away, of the traction device from which the cover of the female member has been removed.

DESCRIPTION OF THE PREFERRED EMBODIMENT

Figure 1:
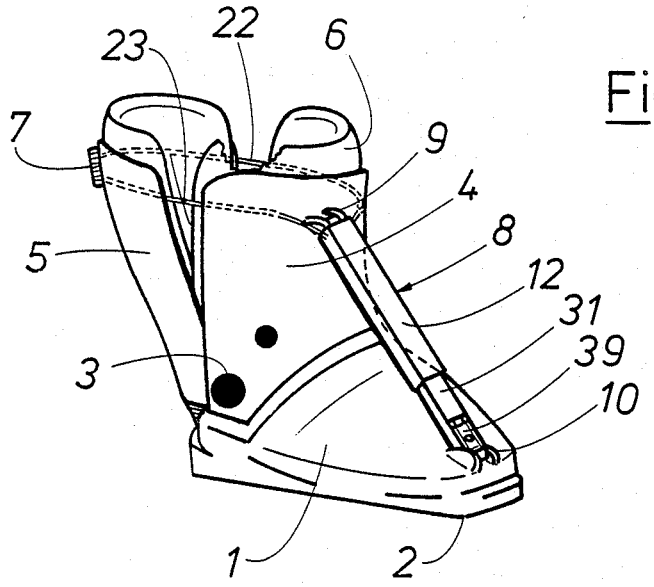
FIG. 1 is a diagrammatic perspective view of the ski boot of the present invention in its open condition.
Figure 2:
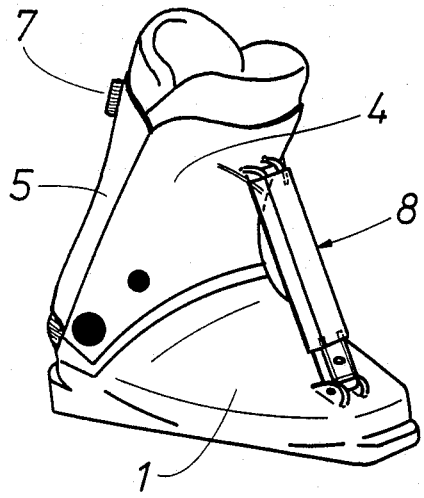
FIG. 2 is a view similar to FIG. 1 but showing the ski boot in its closed condition.

The shell-type ski boot illustrated in FIG. 1 of the drawings and consisting essentially of molded plastic comprises a lower shell 1 molded integrally with a sole 2 and an upper or shaft split into a front quarter 4 and a rear quarter 5 fulcrumed on the lower portion 1 by means of a pair of opposed rivets 3. A soft slipper 6 having its upper likewise split into two portions to as to open and close in harmony with the boot upper is fitted in the boot. Fitted to the upper and rear portion of the rear quarter 5 of the boot upper is a means for anchoring the ends of a pair of cables 22, 23 extending each around one side of the rear quarter 5 and thorugh guide means, and around one side of the front quarter 4, also through gudie means, the opposite ends of said cables 22, 23 being attached to a telescopic traction device 8 having its ends pivotally connected the one to the upper portion of the front quarter 4 of the upper by means of a stirrup 9 and the other to the lower portion 1 of the boot between a pair of parallel projections 10 adjacent the toe end of the boot. The means 7 for anchoring the rear ends of cables 22, 23 may consist for example of a rotary drum permitting of adjusting the cable length. This device is known per se and therefore it is not deemed necessary to describe it in detail. Of course, any other known and suitable means may be used for adjusting the cable length, for example a screw and nut device of the type used for adjusting bicycle cables. The purpose of the telescopic traction device 8 is to pull the cables 22, 23 when the front quarter 4 of the boot upper is bent forward, this movement being attended by the compression of the telescopic device 8. The function of this telescopic traction device 8 is to multiply the reduction in length thereof so as to close the boot by causing the interfitting of the front and rear quarters 4, 5 as shown in FIG. 2.

The telescopic traction device 8 will now be described more in detail with reference to FIGS. 3–5 of the drawings.

The female member of the telescopic traction device 8 consists of an essentially elongated, rectangular metal base plate 11 pivotally connected to the wings of the upper stirrup 9, and of an elongated rectangular cover 12 of U-shaped cross-sectional configuration, overlying the base plate 11 and positioned on the one hand by a stud 13 connected to a cross member 30 projecting above said base plate 11, and on the other hand by a pair of lugs 14 projecting laterally from said base plate 11 and adapted to engage corresponding nothces 15, 16 of said covers 12. This cover 12 is secured to base plate 11 by means of a nut 17 engaging the threaded end of an axle 18 extending upwards at right angles to base plate 11 and having rotatably mounted thereon a first pair of coaxial pulleys 19, 20 of same diameter. Mounted on said axle 18 between said pulleys 19, 20 is an anchor lug 21 to which the end 23*a* of cable 23 is attached. Formed in the inner and opposite faces of plate 11 and cover 12 are a pair of identical grooves 24 and 25 having each a first rectilinear section parallel, but slightly shifted laterally with respect to, the longitudinal axis of the telescopic device 8, and a curved section respectively 24*a*, 25*a* directed toward the other side of said longitudinal axis. The purpose of these grooves 24, 25 is to receive and guide another axle 26 having rotatably mounted thereon another pair of coaxial pulleys 28, 29 having a diameter smaller than that of pulleys 19, 20. The two pairs of pulleys 19, 20 and 28, 29 constitute together a pair of pulley-blocks, that is, one 19, 20 for cable 22 and another 28, 29 for cable 23. Thus, the cable 22, after passing around the ski-boot upper 5, 4, firstly passes through one wing of cross member 30 of plate 11, then around pulley 29 and pulley 28, and its end 22*a* is eventually attached to base plate 11. The other cable 23 passes through the opposite wing of cross member 30, then around pulley 19 and pulley 29, and its end 23*a* is eventually attached to anchor lug 21.

The male member of the telescopic traction device 8 consists essentially of a U-section rectangular metal member 31 fulcrumed on stirrup 10. The upper edge of one lateral wing of this U-section member 31 has a portion bent inwardly and parallel to base plate 11. On the greater part of its length, the width of this in-turned portion 32 is such that it permits the free passage of the axle 18 of pulleys 19 and 20. However, the end 33 of this in-turned edge portion 32 engages the axle 26 of pulleys 28 and 29 when this axle 26 engages the rectilinear section of grooves 24 and 25. The same bent portion 32 extends therefore between grooves 24 and 25, along the rectilinear section thereof, but only in this rectilinear section, so that when the pin 26 of pulleys 28 and 29 engages the curved sections 24*a* and 25*a* of said grooves, the pulleys 28 and 29 clear the end 33, and the bent portion 32 can move past the pulleys 28 and 29. The bent portion 32 has a notch 36 formed therein which acts as a stop for limiting the permissible movement of pin 18 and consequently the extension of the traction device.

The opposite side of male member 31 is also provided with a bent portion 34 substantially parallel to base plate 11, but this bent portion 34 and the lateral wing in which it is formed terminate at a shorter distance than bent portion 32, so that its end 35 cannot interfere with the movement of pulleys 28 and 29 when their axle 26 engages the curved sections 24*a* and 25*a* of grooves 24 and 25. However, the length of the bent edge portion 34 is sufficient for properly guiding the two telescopic members in relation to each other. Along a predetermined length, these bent portions 32 and 34 constitute two parallel arms between which a gap is formed to permit the passage of the axle 18 of pulleys 19 and 20. A corresponding slot is provided in the bottom of male member 31. Fitted in the bottom of this male member 31 is a rectangular block 37 of rubber or other suitable elastomer constituting a resilient stop member for damping out the movement of pulleys 19 and 20 at the end of their movement. In addition, fulcrumed on the pivot pin 38 of male member 31 is a pawl 39 parallel to the axis of the telescopic traction device, this pawl 39 bearing on said resilient block 37 so that the latter also acts as a return spring to said pawl 39. This pawl 39 has a bent lower portion engaged by the resilient block 37 so as to hold the pawl 39 in its operative position. This pawl 39 has two noses 40 and 41 adapted to engage a pair of notches 42 and 43 formed therein by the ends of two longitudinal parallel grooves 44 and 45 cut in the inner face of cover 12 of the female member. This pawl 39 may also be raised to the position shown in dash and dot lines at 39' when it is desired to fit the resilient block 37 in position or to replace this block, for example with a block of different hardness.

The traction device of the present invention operates as follows: In the open ski-boot position (FIG. 1) the axle 18 of pulleys 19 and 20 abutes the notch 36, the sets of pulleys 19, 20 and 28, 29 are very close to each other and the axle 26 of pulleys 28 and 29 is disposed at the lower ends of said grooves 24 and 25. The pawl 39 is retracted from the cover 12 of the female member. When the user, after having put on the boot, bends his knee, the telescopic traction device 8 is compressed so that the end 33 of the longer arm of male member 31 pushes the axis 26 of pulleys 28 and 29 along the rectilinear sections of grooves 24 and 25 and both sets of pulley-blocks 19, 20 and 28, 29 move away from each other. Due to the pulley-block action, the increment in the distance between the two sets of pulley-blocks is attended by a reduction in length of cables 22, 23 which corresponds to twice said distance, so that the two quarters 4 and 5 of the ski-boot upper close very rapidly. The initial length of the cables and the reduction in length resulting from this movement are so selected that the boot upper fits tightly against the skier's ankle and leg. At the end of the rectilinear movement of the axle 26 of pulleys 28 and 29 (as shown in FIGS. 3 and 5), which corresponds to the closing and tightening of the boot upper, this axle 26 engages the curved sections 24*a* and 25*a* of grooves 24 and 25 and clears the terminal end or tip 33 of bent portion 32. The male member 31 can pursue its penetration of the female member 11, 12 without increasing the distance between the two sets of pulleys, that is, without increasing the tightening of the boot upper. Simultaneously or substantially simultaneously the pulleys 19, 20 abute the block 37 of resilient material so as to slightly compress same and the noses 40, 41 of pawl 39 drop behind the notches 42, 43 respectively of the female member. Under these conditions, the telescopic traction device 8 is locked in its closed position and ready for skiing practice. When skiing downhill, the block 37 of resilient material acts as an elastic stop imparting the necessary resiliency to the ski boot under bending stresses.

To take off the ski boot, it is only necessary to release the traction device 8 by exerting a pressure on the pawl 39 so as to remove its noses 40, 41 from notches 42, 43 and to straighten the leg. Then, the boot take-off position of FIG. 2 is obtained by simply tilting the rear quarter 5 of the upper the boot backwards. The pressure may be exerted on pawl 39 by means of the tip of a ski pole, and for this purpose the pawl 39 is provided with a hollow 46 adapted to be engaged by this tip.

Of course, many modifications and variations may be brought to the telescopic traction device 8, within the frame of the invention. Thus, for example, the end stop 33 may be caused to engage directly the axle 26 by moving between the pulleys 28 and 29, thus reducing appreciably the braking action exerted on these pulleys. The sets of pulleys could comprise more than two pulleys, in case it were deemed necessary to increase the multiplication of the stroke of the telescopic device. The curved sections 24*a* and 25*a* of grooves 24, 25 could be simply rectilinear, and a single cable may be used if desired instead of two cables. Furthermore, if desired the pawl 39 may be mounted on the other telescopic member and, if desired, replaced by a pair of lateral pawls.

I claim:

1. A shell-type ski-boot opening at the rear, which comprises a rigid plastic molded lower portion, an upper fulcrumed on said lower portion which consists of a front quarter and of a rear quarter pivotally interconnected, and means for closing the upper which are actuated automatically when said front quarter of the upper is bent forwards, said automatic closing means comprising:

a pair of cables having one end anchored to the rear quarter of said upper and the other end attached to a traction device disposed between said front quarter of the upper and the toe end of said rigid lower portion of the shell, said traction device comprising two telescopically interfitting members having their outer ends pivotally attached to said upper and to said lower portion, respectively, the member attached to said upper comprising two sets of pulleys constituting a pulley-block for each cable, the first set of pulleys being rotatably mounted on an axle movable in guide means comprising a rectilinear section parallel to the direction of relative movement of said telescopically interfitting members, another section of said guide means, on the toe end side, being curved, the telescopic member attached to said lower portion of the shell comprising stop means overlying said rectilinear section of said guide means and constituting abutment means for said movable set of pulleys, said curved section of said guide means shunting said abutment means so that said abutment means can move past said pulleys when the axle of said movable pulleys engage said curved section of said guide means, said cables being anchored to the telescopic member attached to said upper, and automatic means for interlocking said telescopic members when said telescopic members are in their position of maximum mutual engagement.

2. The ski boot of claim 1, wherein said means for automatically interlocking said telescopic members consists of a pawl fulcrumed on one of said telescopic members and adapted to engage a notch formed in the other of said telescopic members.

3. The ski boot of as in any of claims 1 or 2, wherein the interpenetration of said telescopic members is limited by resilient means.

4. The ski boot of any of claim 3, wherein said resilient means consists of a block of elastomer acting at the same time as a return spring to the pawl disposed above said block.

5. The ski boot of claim 4, wherein the lower end of said telescopic traction device pivotally attached to said lower portion of the shell has the configuration of a parallelipipedic box of which the cover consists of said pawl, said box enclosing said block of elastomer.

6. The ski boot of claim 5, wherein said telescopic device pivotally attached to said lower portion of the shell comprises a male member having a relatively long longitudinal arm of which the outer end constitutes said abutment member and a relatively short parallel longitudinal arm disposed on the same side as said curved section of said guide means, the other telescopic member consisting of a tubular female member of which the axle on which the set of fixed pulleys are rotatably mounted extends between said longitudinal arms of said male member.

* * * * *